US006484480B2

(12) United States Patent
Rauch

(10) Patent No.: US 6,484,480 B2
(45) Date of Patent: Nov. 26, 2002

(54) MULTI-LAYER SADDLE PAD

(76) Inventor: Steven Rauch, 31257 Via Puerta del Sol, Bonsall, CA (US) 92003

( * ) Notice: Subject to any disclaimer, the term of this patent is extended or adjusted under 35 U.S.C. 154(b) by 0 days.

(21) Appl. No.: 09/776,210

(22) Filed: Feb. 2, 2001

(65) Prior Publication Data

US 2002/0104295 A1 Aug. 8, 2002

(51) Int. Cl.[7] ..... B68C 1/12
(52) U.S. Cl. ..... 54/66
(58) Field of Search ..... 54/65, 66

(56) References Cited

U.S. PATENT DOCUMENTS

| | | | | | |
|---|---|---|---|---|---|
| 189,694 | A | * | 4/1877 | Burgess | 54/65 |
| 4,351,683 | A | | 9/1982 | Kusilek | |
| 4,974,397 | A | | 12/1990 | Ricken | |
| 5,018,341 | A | * | 5/1991 | Evertson | 54/66 |
| 5,119,618 | A | | 6/1992 | Streck | |
| 5,175,986 | A | * | 1/1993 | Farley | 54/44.1 |
| 5,353,577 | A | * | 10/1994 | Thurston | 54/66 |
| 5,456,876 | A | | 10/1995 | Redwine et al. | |
| 6,065,273 | A | | 5/2000 | Schneider | |
| 6,067,781 | A | | 5/2000 | Ford et al. | |

OTHER PUBLICATIONS

Arcaro's Saddlery Online Catalog, Date Unknown.

* cited by examiner

*Primary Examiner*—Robert P. Swiatek

(57) ABSTRACT

A multi-layer equine saddle pad. The saddle pad is made of non-woven polypropylene material that is both durable and has high-moisture performance. The multiple layers are attached by stitching or bonding together along their centerlines such that the attachment terminates short of either end of the non-woven material layers. The multiple-layer pads are maintained free from any permanent attachments along their edges.

6 Claims, 1 Drawing Sheet

MULTI-LAYER SADDLE PAD

BACKGROUND OF THE INVENTION

The present invention relates to a multi-layer equine saddle pad.

Traditional equine saddle pads have been primarily used to protect from abrasions and chafing caused by the saddle and straps and also to provide additional comfort for the rider. Known saddle pads are typically comprised of wool, animal hair, or synthetic materials. Certain saddle pads are configured by securing multiple layers of the various materials that are stitched together around the edges or joined along the edges by Velcro.® The material used in such pads may have a fused edge band to resist shagging and delamination of the filaments along the pad edges. Other saddle pads are formed of multiple layers that are releasably attached by Velcro® in order to allow for the saddle to be customized for use with a particular horse by the addition of material where the pad should be built up.

One problem with the prior art saddle pads is that by configuring the saddle pad by stitching together around the edges or joining along the edges by Velcro®, the pad can be uncomfortable in specific areas such as on the horse's withers. While these configurations provide effective slip resistance between the horse's back and the saddle, therefore securing the relative position of the saddle on the horse, they are not the most comfortable for the horse or rider. Any movement of the saddle is transferred into abrading friction on the horses back. Therefore, there is a need for a multi-layer saddle pad that is configured in a manner that is stable yet provides for greater comfort for both the horse and the rider while on the horse.

Another problem with the prior art saddle pads is that they are not made of material that has both durability and high moisture performance. Certain saddle pads have been made of polyester, polyurethane and polyurethane foams. These materials provide particular advantages such as resilience, moisture wicking, or superior ventilation capacity. However, none of these materials provide for both enhanced durability and moisture performance. Thus, there is a need for a saddle pad made of a synthetic material that is both durable and has high moisture performance (including water permeability, moisture damage resistance and good moisture wicking capability).

SUMMARY OF THE INVENTION

It is an advantage of the present invention that it provides a new and improved multi-layer saddle pad that is configured for comfort to both the horse and the rider and that is also made of a non-woven fabric that is durable, and has high moisture water performance.

According to one aspect of the present invention, a multi-layer equine saddle pad is provided, which comprises two or more layers of non-woven material. Three layers are preferred. Where three layers are provided, the innermost layer is the one that is placed on the horses back. An intermediate layer is disposed over the inner layer and an outermost layer is disposed of on top of both the inner and intermediate layers. The outermost layer is the one on which the saddle would rest and improve comfort to the rider by shock absorption and abrasion in the area where the riders legs pass over the pad.

The three layers are secured to each other by being stitched or bonded down their centerline. The stitching or bonding does not continue to the end of the centerline, but instead terminates approximately 6 inches short of each end. The advantage to this configuration is that both the end placed at the horse's wither and the opposite end placed on the horse's back are able to open in such a manner as to provide more comfort to the horse and the rider. Additionally, all three layers are maintained free from attachments at any edge and are untreated in that they are neither stitched nor bonded. This arrangement provides dual advantages in that it provides for more comfort to the horse and rider once positioned on top of the saddle. Greater comfort is achieved for the rider because of the cushioning effect from the thick pad. The resilience of the pad also means, that less impact is transferred to the horse by the movement of the rider. In addition there is less abrasion of the horse's back because any movement of the saddle tends to move only the uppermost layer of the pad. Friction caused by relative movement between layers tends to damper the movement of the saddle so that less movement (and therefore less abrasion) is transferred to the horse's back. Additionally, the fact that each layer is free from attachments allows all three layers of the saddle pad to be spread out more easily in order to dry faster once the saddle pad has been washed. Lastly, the fact that the ends are free from attachment, makes it possible to customize the pad by cutting portions away where less material is desirable. For example, a full sized pad may be cut down for use with a childs saddle on a pony.

All three layers are made of the same non-woven material which is a polypropylene material commonly known as "non-woven geotextile." This material is 26 ounce per square yard non-woven polypropylene material. It is ¼ inch thick and burnished, or heat treated, on one side. Because the material is non-woven, it possesses the advantage that it may be cut without fraying or unraveling. Therefore, if a saddle pad is cut into a certain configuration that accommodates for high withered horses, it will not adversely affect the saddle pad in any manner, nor will it cause the pad to unravel and therefore require continual premature replacement. Another feature of the non-woven geotextile is that it is water permeable. This characteristic provides a great number of advantages. First, it allows the saddle pad to dry quickly after it has been washed. Therefore a rider does not have to have as many saddle pads because one can be washed and ready for re-use in a relatively short time. Additionally, the water permeable characteristic allows perspiration from the horse's back, or other liquids, to be wicked up through the saddle pad in an expeditious manner so that the pad does not become heavy from the retention of liquids and the horses back is dryer. When the pad is removed, such as after a days ride, the layers of the pad may be separated so that the pad air drys quickly. Moreover, the non-woven geotextile is flexible and lightweight so that it does not become burdensome to pick up and move around, nor does it make either the horse or its rider uncomfortable once placed under the saddle. Finally, the non-woven geotextile is both resilient and highly durable. Use of this material is ideal for horseback riding because it is comfortable but also durable enough to withstand the pressures and continual movement adjustments of a rider while on the horse's back. Such durability means that the saddle pad will not require continual replacement because of damage done to the pad while riding.

Because the non-woven geotextile does not fray or unravel when it is cut, this allows the material to be cut for many different purposes. As previously discussed, the part of the saddle pad placed closest to the horse's withers may be cut to accommodate for different horse physiology. Additionally, the outer most layer may be cut in order to make one or more slits to accommodate equipment attached to the outer layer. Where slits are utilized, the outer layer may contain a girth which is a band around the horse that holds the saddle more securely in place. This girth may be placed around the horse and positioned securely through the slits to ensure that the girth does not more relative to the saddle pad. This allows a rider to elect to ride bareback on the horse with merely the saddle pad because the saddle pad is secured to remain in position without slipping from its proper position. Additionally, other types of equipment may be connected to the saddle pad in this manner, including water containers or the like.

Alternatively, the non-woven geotextile allows for holes to be cut away at the fore and aft positions of the saddle pad to make handles. Such handles provide ease in lifting the saddle pad from a stored position or from the horse's back.

The use of the non-woven geotextile material in a multi-layer saddle pad in a configuration that is attached through a centerline but terminates short of both ends increases comfort of the saddle pad as well as provides great durability and water permeability. Therefore maximum comfort to both the horse and rider can be obtained without increasing expense or resulting in disadvantages from saddle pads that are stitched together around the edges or joined along the edges.

The use of polypropylene material reduces odor because, unlike natural fibers, the geo-textile fabric is non-microbial and does not support the growth of odor causing bacteria.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
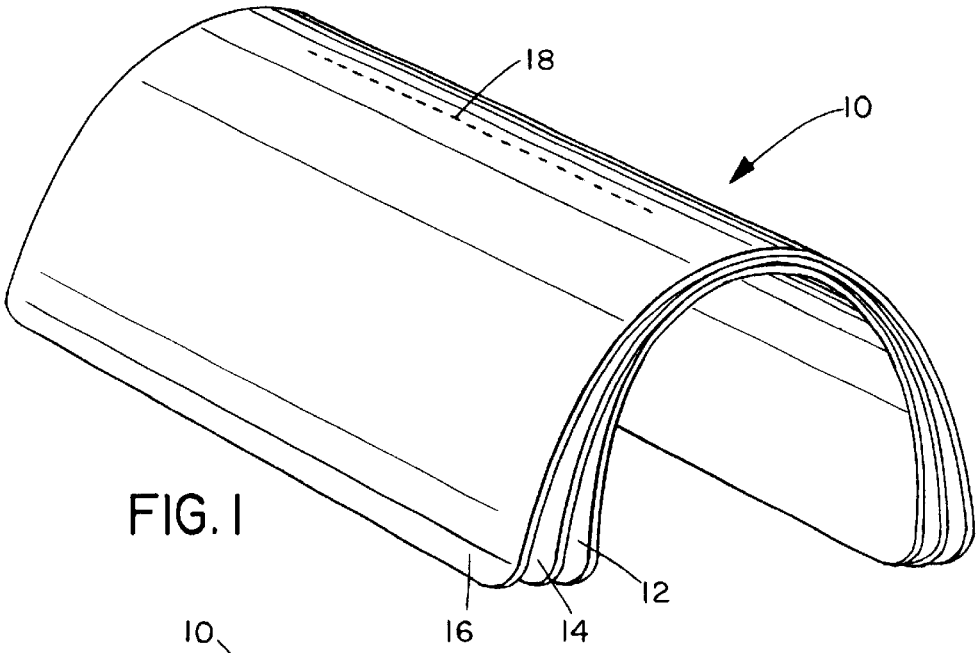
FIG. 1 is a perspective of the multi-layer saddle pad.

FIG. 1 illustrates a front view of the equine multi-layer saddle pad 10. The saddle pad 10 comprises an inner layer 12, an intermediate layer 14, and an outer layer 16. In the illustrated embodiment, all three layers are relatively the same size. The inner 12, intermediate layer 14 and outer layer overlie one another in relative alignment. These layers are attached to each other by being stitched, attached by adhesive, or bonded in any other appropriate manner. In the alternative the inner layers may be slightly lower (approximately one inch) to create a more tapered transition for the girth strap 26.

In the exemplary embodiment the layers 12, 14, 16 are secured to each other by being stitched or bonded down their centerline 18. The stitching does not continue to the end of the centerline 18, but instead terminates approximately 6 inches short of each end. All three layers 12, 14, 16 are maintained free from attachments at any peripheral edge. Preferably, there is not even temporary attachment (as by Velcro®) on any edge, and therefore the only attachment of the three layers 12, 14, 16 occurs at the centerline 18. The fact that the layers are attached together only along the center line, means that there is less movement of the inner layer against the horse's back. Since the upper layer (except at the centerline) is free to move relative to the intermediate and inner layers, there is less, abrading of the horse's back. The relative movement of the saddle is stabilized by the damping frictional engagement between layers which dissipates most of the energy that would otherwise by absorbed by the horse's back.

In addition to the previously described advantages of the geo-textile material, it has been found that the material does not attract and adhere hair in mats as is common with natural fibers.

The fact that the edges are free from attachment, also makes it possible to spread the layers apart for drying. Since air can reach all the way to the center line and each layer is only ½ inch thick, the pad dries quickly.

Figure 2:
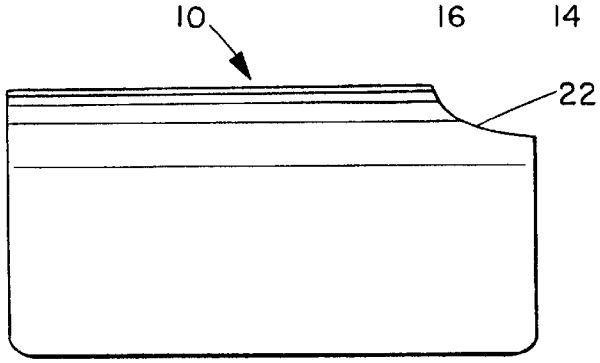
FIG. 2 is a side view of the saddle pad with a portion of the saddle pad cut away.

FIG. 2 is a view of the saddle pad 10 cut away at portions to accommodate for various shaped horses. The cut away portion 22 allows for horses with higher than normal withers to use the present saddle pad 10 by merely cutting away those portions 22 that interfere with the horses withers. The non-woven textile material comprising the layers of the present saddle pad 10 allow for such cuts 22 to be made without fraying or unraveling the material.

Figure 3:
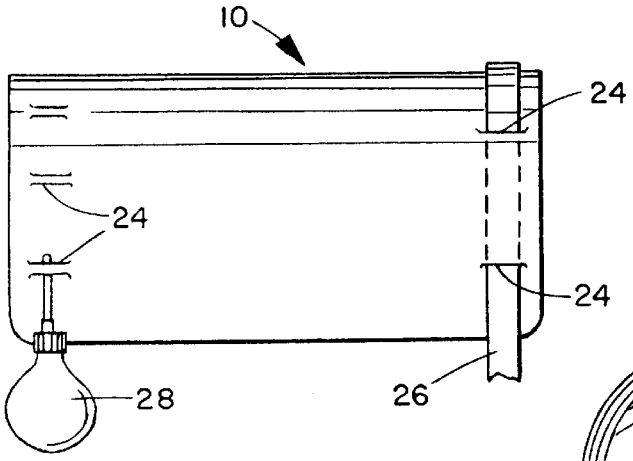
FIG. 3 is a side view of the saddle pad illustrating the slits made for attaching equipment to the saddle pad.

FIG. 3 is a view of the saddle pad 10 illustrating the slits 24 made for attaching equipment to the saddle pad 10. The outer layer 16 has slits 24 cut into it that allow for various types of equipment to be attached to the saddle pad 10. With the slits 24 into the pad, the outer layer may receive a girth 26 for securing around the horse that is also secured to the saddle pad 10. Additionally, other types of equipment may be connected to the saddle pad 10 through the slits 24 in this manner, including water containers 28 or the like.

Figure 4:
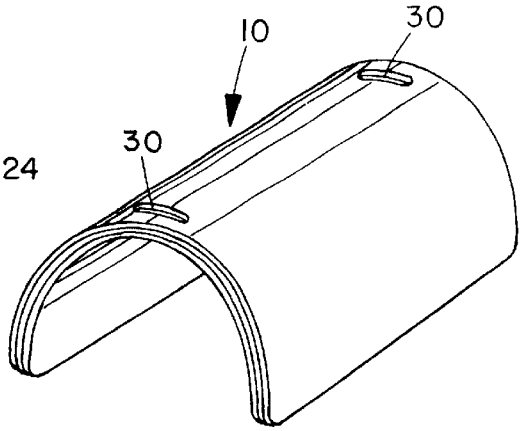
FIG. 4 is a perspective view of the saddle pad illustrating holes cut away to allow for ease in handling the saddle pad.

Finally, FIG. 4 is a view of the saddle pad 10 illustrating handgrip holes 30 cut away to allow for ease in handling the saddle pad. The holes 30 are cut at locations fore and aft on the saddle pad 10 in order to allow a user to lift the saddle pad 10 more easily when it is either in a stored position or alternatively when it is positioned on the horse.

Although an exemplary embodiment of the invention has been described above by way of example only, it will be understood by those skilled in the field that modifications may be made to the disclosed embodiment without departing from the scope of the invention, which is defined by the appended claims.

I claim:

1. A multi-layer equine saddle pad comprising:

at least two layers including an inner layer of durable non-woven material; and an outer layer of durable non-woven material disposed over said inner layer and secured to said layers along its centerline by an attachment that terminates short of both ends of the centerline;

wherein the durable non-woven material comprises an assembly of sheets of a polypropylene material and where said layers are not permanently attached to each other along their edges.

2. The saddle pad claimed in claim 1 further including:

at least an intermediate layer of durable non-woven material disposed between said inner layer and outer layer and secured to said inner layer along its centerline by an attachment that terminates short of both ends of the centerline.

3. The saddle pad claimed in claim 2 wherein one or more of said layers are cut away to accommodate for high withered horses.

4. The saddle pad claimed in claim 2 wherein said outer layer is cut in multiple slits to accommodate equipment attached to said outer layer through said slits.

5. The saddle pad claimed in claim 2 wherein said inner, intermediate, and outer layers are cut away in a plurality of locations in order to allow for handles to lift said saddle pads.

6. The saddle pad claimed in claim 1 wherein the polypropylene material is burnished on one side, ¼ inch thick, and 26 ounce per square yard non-woven material.

* * * * *